US007770815B2

(12) United States Patent
Green et al.

(10) Patent No.: US 7,770,815 B2
(45) Date of Patent: Aug. 10, 2010

(54) ADJUSTABLE FLOW NOZZLES

(75) Inventors: Charles T. Green, San Marcos, CA (US); Jeffrey A. Wichmann, San Diego, CA (US)

(73) Assignee: Zodiac Pool Care, Inc., Vista, CA (US)

( * ) Notice: Subject to any disclaimer, the term of this patent is extended or adjusted under 35 U.S.C. 154(b) by 364 days.

(21) Appl. No.: 11/805,313

(22) Filed: May 23, 2007

(65) Prior Publication Data

US 2007/0290078 A1 Dec. 20, 2007

Related U.S. Application Data

(60) Provisional application No. 60/808,300, filed on May 25, 2006.

(51) Int. Cl.
*B05B 17/04* (2006.01)

(52) U.S. Cl. ..... 239/11; 239/16; 239/17; 239/465; 239/505; 239/587.1; 239/587.4; 239/589; 239/590; 239/580; 239/12

(58) Field of Classification Search ..... 239/456–458, 239/505, 513, 514, 518, 521, 524, 537–540, 239/587.1, 587.4, 465, 580, 11, 12, 16, 17, 239/589, 590.5

See application file for complete search history.

(56) References Cited

U.S. PATENT DOCUMENTS

| | | | | |
|---|---|---|---|---|
| 1,724,662 | A | 8/1929 | Johnson | |
| 1,917,216 | A | 7/1933 | Bersted | |
| 1,942,395 | A | 1/1934 | Bersted | |
| 2,156,800 | A * | 5/1939 | Bucknell et al. | 239/457 |
| 2,557,106 | A | 8/1951 | Hughes | |
| 2,589,255 | A | 8/1951 | Pagliuso | |
| 2,935,265 | A * | 5/1960 | Richter | 239/587.4 |
| 2,985,385 | A * | 5/1961 | Bowers et al. | 239/456 |
| 2,984,481 | A | 8/1961 | Blumberg | |
| 3,022,014 | A * | 2/1962 | Young | 239/521 |
| 3,081,040 | A | 3/1963 | Hartmann | |
| 4,189,099 | A | 2/1980 | Bruninga | |
| 4,262,371 | A | 4/1981 | Berry et al. | |

(Continued)

FOREIGN PATENT DOCUMENTS

DE 35 10 107 A1 10/1985

(Continued)

OTHER PUBLICATIONS

Annex to Form PCT/IS/206 Communication Relating to the Results of the Partial International Search in related International Application No. PCT/US2007/012247.

*Primary Examiner*—Steven J Ganey
(74) *Attorney, Agent, or Firm*—Dean W. Russell; Jason D. Gardner; Kilpatrick Stockton LLP

(57) ABSTRACT

Adjustable nozzles are disclosed. Nozzles of the present invention include an adjustable component for controlling the water flow through the nozzle. Instead of disassembling the nozzle, a tool may be used to adjust the adjustable component. For example, the adjustable component may be adjusted longitudinally with respect to the axis of the nozzle or rotationally using the tool, thereby increasing or decreasing the volume, velocity and distance of the water stream exiting the nozzle.

13 Claims, 8 Drawing Sheets

U.S. PATENT DOCUMENTS

| | | | |
|---|---|---|---|
| 4,408,721 | A | 10/1983 | Cohen et al. |
| 4,657,185 | A | 4/1987 | Rundzaitis |
| 5,129,584 | A | 7/1992 | Ridenour |
| 5,749,518 | A | 5/1998 | Wang |
| 6,409,103 | B1 | 6/2002 | Norville et al. |
| 6,592,057 | B1 | 7/2003 | Ericksen et al. |
| 6,619,570 | B1 | 9/2003 | Ericksen et al. |

FOREIGN PATENT DOCUMENTS

| | | | |
|---|---|---|---|
| EP | 1 043 077 | A2 | 10/2000 |
| EP | 1 043 077 | A3 | 10/2000 |

* cited by examiner

ADJUSTABLE FLOW NOZZLES

CROSS REFERENCE TO RELATED APPLICATIONS

This application claims benefit of U.S. Provisional Patent Application Ser. No. 60/808,300, entitled "Adjustable Flow Nozzles" and filed May 25, 2006, the entire contents of which are hereby incorporated by this reference.

FIELD OF THE INVENTION

This invention relates to nozzles and more particularly to adjustable nozzles configured to control the flow of water through a conduit.

BACKGROUND OF THE INVENTION

Water flow devices such as ornamental water fountains generally include means for providing water from a source, filling an area such as a basin and draining the water away. In some conventional water fountains, one or more jets are utilized to force water into the air, under pressure, to a desired distance. In other conventional water fountains a nozzle causes the water to reach a certain distance.

Ornamental water fountains may utilize a plurality of nozzles to provide separate streams of water. For instance, the plurality of nozzles may be configured to provide streams of water that travel to the same point. In other arrangements, plurality of nozzles may be configured to provide streams of water that travel to different points and are tailored to be aesthetically pleasing to a viewer. It is often desirable to adjust the nozzle to control the distance of each stream. Over time, streams configured to travel to the same point may need adjusting to continue traveling to the same point. Furthermore, it may be desirable to change the characteristics of streams, such as the volume and velocity of a stream and the distance that one or more streams travels.

In conventional nozzles, a fountain owner or technician adjusts the characteristics of a stream by disassembling the nozzle, adjusting the internal components, and reassembling the nozzle or adjusting upstream valving that controls the water flow to the nozzle. After testing the distance of the water flowing from the adjusted nozzle, the fountain owner or technician may be required to disassemble the nozzle, adjust the internal components a second time, and reassemble the nozzle. These steps may need to be repeated until desired water stream characteristics are achieved.

Disassembling, adjusting the nozzle components, and reassembling the nozzle take a relatively long amount of time. If the nozzle must be reassembled, tested, and adjusted again, the amount of time is even longer. Accordingly, a need exists for a fountain nozzle in which the characteristics, such as volume, velocity, and distance, of the water stream may be adjusted without disassembling the nozzle.

In some conventional water fountain systems, a secondary valve, separate from the nozzle, may control water flow characteristics. These systems may require water fountain owners to purchase a nozzle and a secondary valve to provide the user with control over water flow characteristics. Therefore, a need exists for a water fountain system that does not require the user or water fountain owner to purchase and install a secondary valve in order to allow the user to control the water flow characteristics.

SUMMARY OF THE INVENTION

Various aspects and embodiments of the present invention provide a nozzle having a first end for receiving water, a second end for allowing water to exit and an internal valve for controlling the flow of water through the nozzle. Unlike existing fountain nozzles, the nozzle of the present invention may include a valve having an adjustable component that may be adjusted using a tool or manually. Instead of disassembling the nozzle, the tool may be used to adjust the adjustable component. For example, the adjustable component may be adjusted longitudinally with respect to the axis of the nozzle using a tool (or manually), thereby increasing or decreasing (or otherwise changing) water flow characteristics, such as the volume, velocity and distance of the water stream exiting the nozzle, as desired.

In one embodiment of the invention, the nozzle includes a valve having an adjustable component configured to controllably impinge the flow of water. The adjustable component may be essentially tubular with at least part of the surface threaded for communicating with a nozzle wall and include a first end configured to connect to a tool. A tool may be inserted through a nozzle second end, connected to the adjustable component and used to rotate the adjustable component, thereby changing the adjustable component's position and the amount in which the water flow is impinged.

In another embodiment of the invention, a nozzle may include an adjustable component that is essentially tubular and include a first end for connecting to a tool and a tapered second end for impinging the flow of water. At least part of the adjustable component's outer surface may be threaded for coupling with an internal nozzle wall. The tapered second end cooperates with an internal wall of the nozzle first end to impinge the flow of water. The amount that the water is impinged depends on the location of the adjustable component within the nozzle. A tool inserted into a second end of the nozzle may be used to adjust the location of the adjustable component.

In another embodiment of the invention, a nozzle is provided having an adjustable component that is a spout. The spout may have an outside surface, a first end configured to impinge the flow of water, and a second end configured to connect to a tool for changing the location of the spout. The spout first end may include a plurality of openings located in the first end and configured to allow more or less water to flow through the valve depending on the position of the spout. When the spout changes position, for example by rotating or translating the spout with a tool, the openings allow more or less water to flow through the nozzle, as desired.

In some embodiments of the invention, the nozzle may include a ball socket to allow the angle of the water stream to be adjusted.

In some embodiments of the invention, the tool may be a Phillips, hex or flat screwdriver.

In some embodiments of the invention, water flow characteristics through a nozzle may be adjusted by inserting a tool into a first end of the nozzle, detachably coupling the tool to an adjustable component associated with a valve in the nozzle, rotating the tool to change the position of the adjustable component, and removing the tool from the nozzle first end.

Optional, non-exclusive objects of the present invention include providing a fountain nozzle in which water flow characteristics, such as the volume, velocity, and distance of a water stream may be easily adjusted.

Another optional, non-exclusive object of various embodiments of the present invention is to provide a nozzle in which the volume, velocity, and distance of a water stream may be adjusted without disassembling the nozzle.

It is a further optional, non-exclusive object of some embodiments of the present invention to provide a valve having an adjustable component that may be accessed, using a tool, to adjust the location of the adjustable component.

It is a further optional, non-exclusive object of some embodiments of the present invention to provide a nozzle having an internal valve to adjust the volume and velocity of the flow of water through the nozzle without needing a secondary valve in the water fountain system.

Other objects, features, and advantages of the present invention will become apparent with reference to the remainder of the text and the drawings of this application.

DETAILED DESCRIPTION

Figure 1:
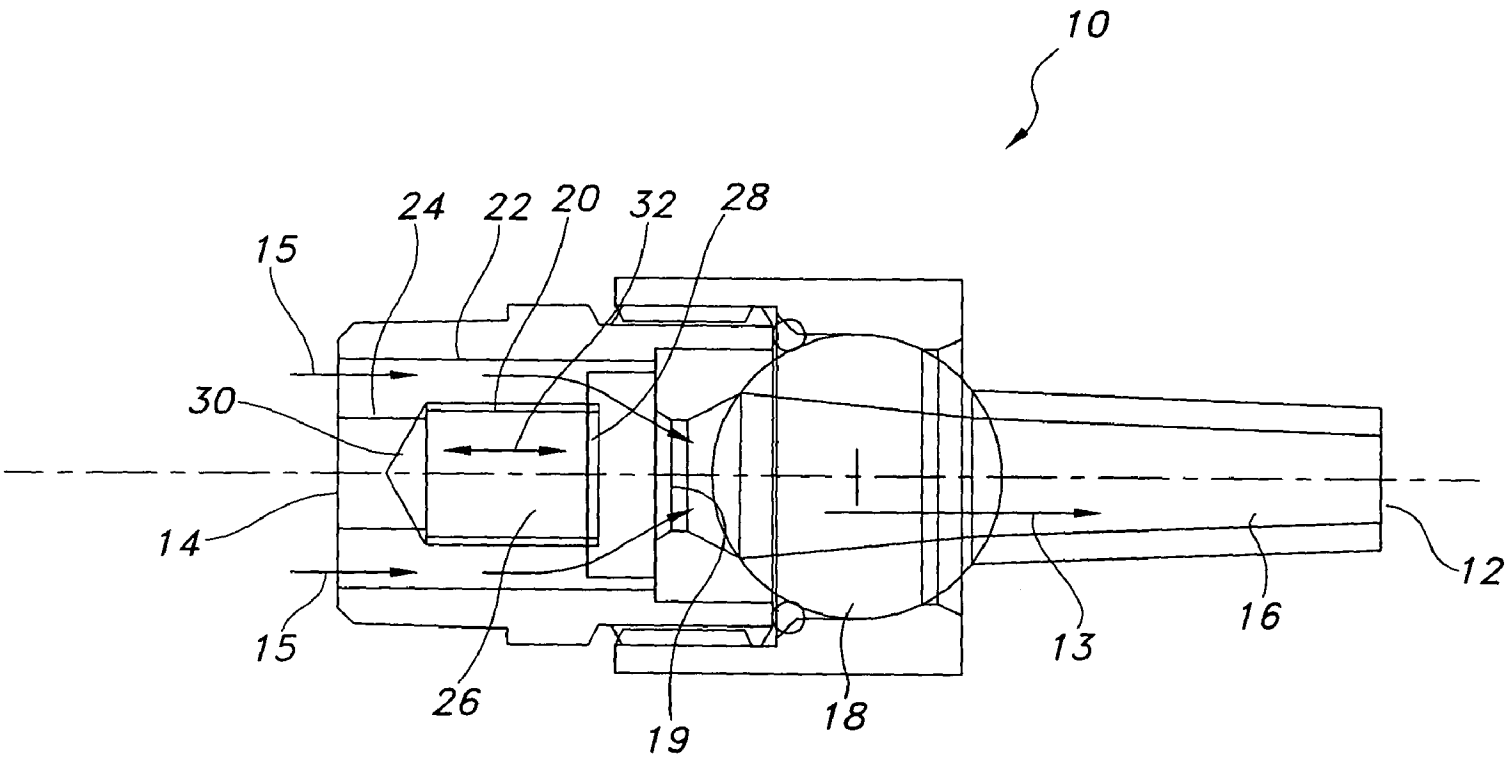
FIG. 1 is a cross-sectional view of a nozzle according to one embodiment of the present invention.

Shown in FIG. 1 is an example of an adjustable water fountain nozzle 10 of the present invention. Nozzle 10 contains a first end 12 to allow water, or other fluid, to exit the nozzle, as illustrated by arrow 13, and a second end 14 to allow water to enter the nozzle, as illustrated by arrows 15. The first end 12 may be a spout 16 connected to a ball socket 18 to optionally allow the angle of the spout 16 to be changed. The ball socket 18 may be connected to a nozzle chamber 19 to allow water to flow through the nozzle 10. The nozzle 10 may also contain a first inner wall 20 and a second inner wall 22. The first inner wall 20 and second inner wall 22 may form a channel 24 for water to flow through. An internal valve, such as an adjustable component 26 may also be included in the nozzle 10.

In the embodiment illustrated in FIG. 1, the adjustable component 26 is a screw having a first end 28 for cooperating with the nozzle chamber to impinge the water flow through the nozzle 10 and configured to receive a tool. The screw may be essentially tubular and also include a tapered second end 30 and a threaded outer surface (not shown). The first inner wall 20 may be configured to receive the threaded outer surface (not shown) of the adjustable component 26. The adjustable component 26 may be made from any material that is not susceptible to rusting due to exposure to water. For example, the adjustable component 26 may be made from plastic, brass, stainless steel, or nickel plated metal.

The location of the adjustable component 26 may be adjusted in accordance with double-headed arrow 32. To adjust the adjustable component 26, a tool such as a screwdriver is inserted through the spout 16 of nozzle first end 12. The tool is connected to the adjustable component first end 28, such as by inserting the tool into a slot or other opening in the adjustable component first end 28 and rotating the tool in one direction to change the adjustable component 26 to further from the nozzle first end 12 and an opposite direction to change the position of the adjustable component 26 to closer to the nozzle first end 12. Depending on the location of the adjustable component 26 relative to the nozzle first end 12, the flow of water through the nozzle may be impinged more or less. For instance, the area available for the water to flow through the nozzle 10 decreases as the adjustable component 26 is adjusted closer to the nozzle first end 12. Accordingly, the volume and velocity of the water exiting the nozzle first end 12 is decreased while the velocity of the exiting water is increased. Similarly, as the adjustable component 26 is adjusted further away from the nozzle first end 12, the volume of the exiting water increases while the velocity decreases. The adjustable component 26 may be adjusted while water is exiting the spout 16 or when water is not flowing through the nozzle 10.

Figure 2:
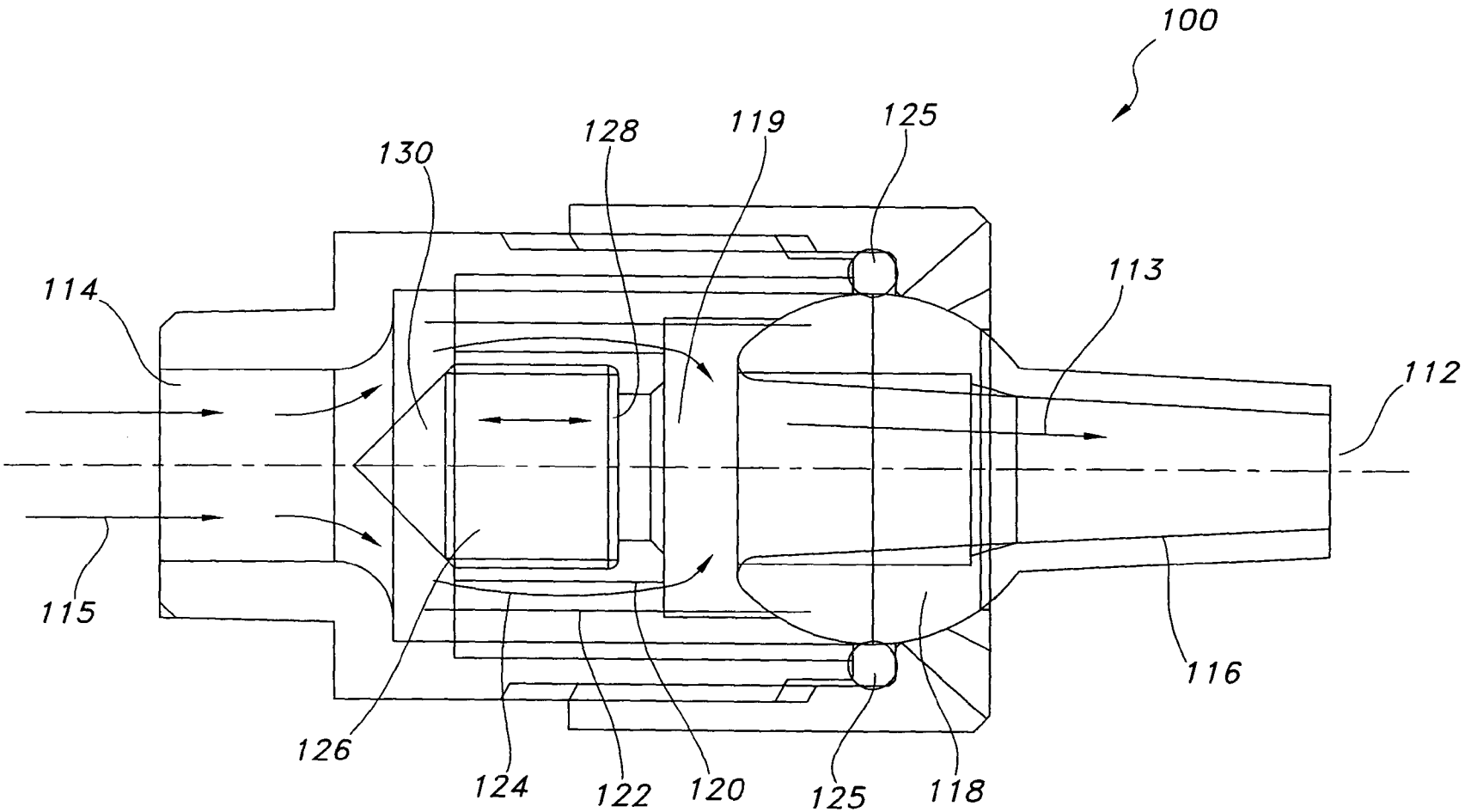
FIG. 2 is a cross-sectional view of a nozzle according to one embodiment of the present invention having a different water impinging configuration than FIG. 1.

FIG. 2 shows a nozzle 100 according to one embodiment of the present invention having an adjustable component 126 that may be adjusted to impinge the water flow through the nozzle 100 to obtain desired water flow characteristics, such as volume and velocity. The nozzle 100 may also include a first end 112 having an opening to allow water, or other fluid, to exit the nozzle, as illustrated by arrow 113 and a second end 114 having an opening to allow water to enter the nozzle, as illustrated by arrows 115. The first end 112 may be a spout 116 connected to a ball socket 118 to optionally allow the angle of the spout 116 to be changed.

The ball socket 118 may be connected to a nozzle chamber 119 to allow water to exit the nozzle 100 at an angle. In some embodiments, an O-ring (not shown) may be conventionally located at the bottom and/or top of the ball socket 118 to form a seal. An O-ring located at the bottom and/or top of the ball socket 118, however, may not allow the ball socket 118 to fully rotate and change angles and/or may allow leaks when the ball socket 118 is rotated since water may flow past the O-ring when the ball socket 118 is rotated to certain positions. Therefore, in some embodiments of the present invention, an O-ring 125 may cooperate with the ball socket 118 at the equatorial position of the ball socket 118 to form a seal. When the O-ring 125 is located at the equatorial position, the ball socket 118 is allowed to fully rotate and the angle of the ball socket 118 may be changed without leaks occurring since the O-ring 125 is not at a position in which water might flow around it. The position of the ball socket 118 may be changed manually or by using the same or a different tool to change the position of the adjustable component 126.

The nozzle 100 may also contain a first inner wall 120 and a second inner wall 122. The first inner wall 120 and second inner wall 122 may form a channel 124 for water to flow through and the adjustable component 126 may be in the channel 124. The adjustable component 126, as illustrated in FIG. 2, is a screw and may include a threaded outer surface (not shown) for connecting with the nozzle first inner wall 120. The adjustable component 126 may further include a first end 128 for receiving a tool and a second end 130 configured to cooperate with the nozzle second end 114 to impinge the flow of water through nozzle 100. The adjustable component second end 130 may be tapered, as illustrated in FIG. 2. Depending on the location of the adjustable component 126 relative to the nozzle second end 114, the water flow through the nozzle may be impinged more or less. For instance, the adjustable component 126 may be adjusted using a tool inserted in the nozzle first end 112 and connected to the adjustable component first end 128. When the tool is rotated in one direction, the adjustable component 126 is adjusted closer to the nozzle second end 114, thereby decreasing the area through which the water may flow through the nozzle and thus decreasing the volume of water exiting the nozzle first end 112 and increasing the velocity of the exiting water flow. When the tool is rotated in the opposite direction, the adjustable component 126 is adjusted further away from the nozzle second end 114, thereby increasing the area through which the water may flow and thus increasing the volume of water exiting the nozzle first end 112 and decreasing the velocity of the exiting water flow.

Figure 3A:
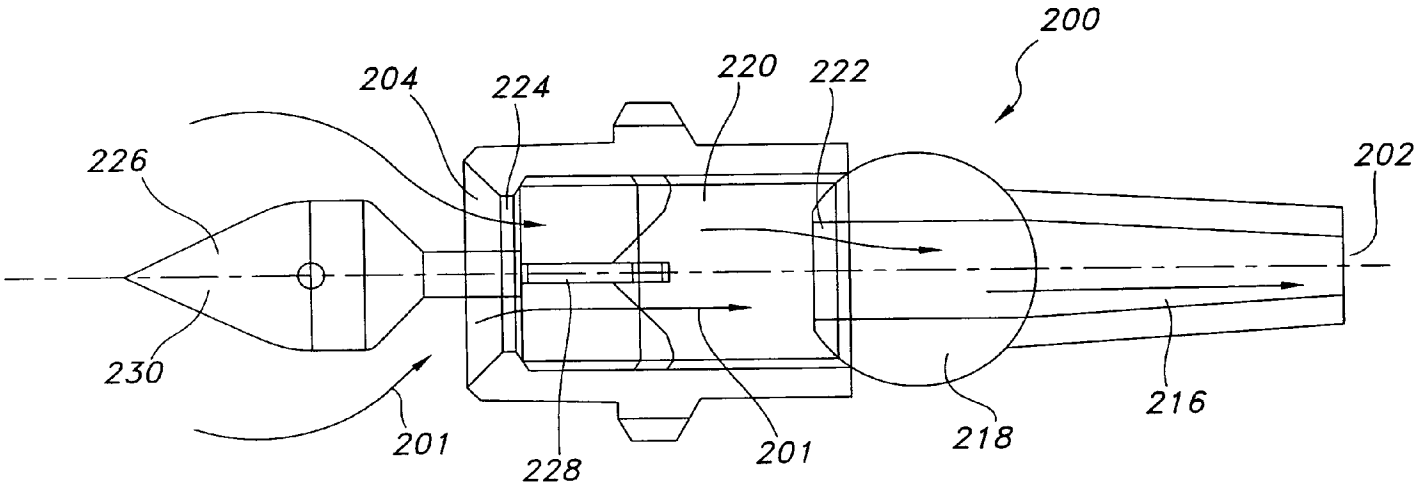
FIG. 3A is a cross-sectional view of a nozzle according to one embodiment of the present invention having an adjustable plug for impinging the water flow.

FIG. 3A shows a nozzle 200 having a first end 202 having an opening for allowing water to exit the nozzle 200 and a second end 204 for allowing water to enter the nozzle 200. The nozzle first end 202 may include a spout 216 connected to a ball socket 218 to optionally allow the angle of the spout 216 to be changed. The nozzle 200 may further include a nozzle chamber 220 having a first end 222 connectable to the ball socket 218 and a second end 224 having an opening and cooperating with an adjustable component 226 to impinge the flow of water through the nozzle 200.

The adjustable component 226, as illustrated in FIG. 3A, may be a plug having a first end 228 for receiving a tool to adjust the location of the plug and a second end 230 for cooperating with the nozzle chamber second end 224 to impinge the flow of water, indicated by arrows 201, through the nozzle 200. The plug may be any shape or configuration adapted to cooperate with the nozzle chamber second end 224 to impinge the flow of water through the nozzle at different levels depending on the location of the plug. The outer surface of at least a portion of the adjustable component first end 228 may be threaded and cooperate with a nozzle chamber inner wall (not shown) to hold the adjustable component 226 in a desired location or allow the location of the adjustable component 226 to be changed as desired.

For example, a tool, such as a screwdriver or other similar device, may be inserted through the spout 216, connected to the adjustable component first end 228, and rotated to change the location of the adjustable component 226. As the adjustable component 226 is adjusted closer to the nozzle chamber second end 224, the impingement of the water flow is increased, thereby decreasing the volume of water exiting the nozzle spout 216 and increasing the velocity of the exiting water. As the adjustable component 226 is adjusted further away from the nozzle chamber second end 224, the impingement of the water flow is decreased, thereby increasing the volume of water exiting the nozzle spout 216 and decreasing the velocity of the exiting water.

Figure 3B:
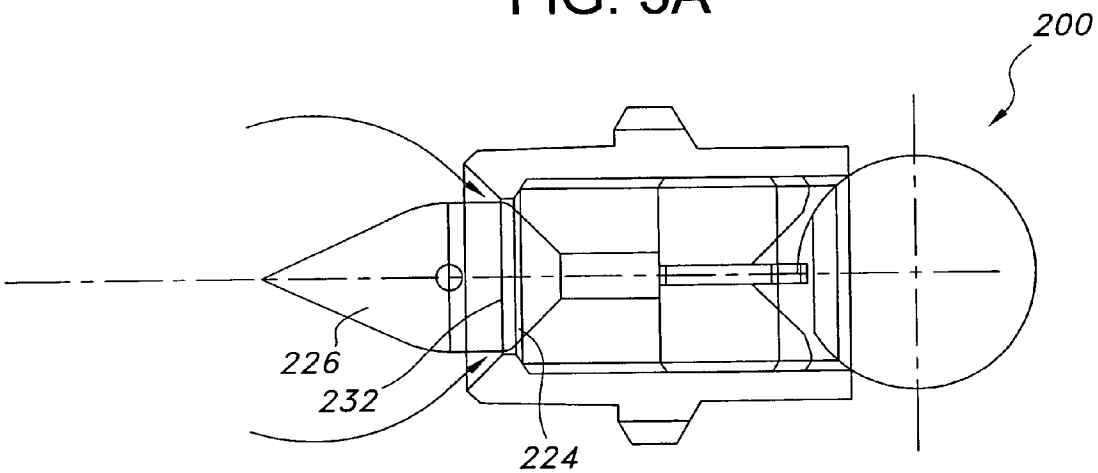
FIG. 3B shows the adjustable plug of FIG. 3A impinging the flow of water through the nozzle.

As illustrated in FIG. 3B, the adjustable component 226 may cooperate with the nozzle chamber second end 224 to completely prevent the flow of water through the nozzle 200. In some embodiments, an O-ring 232 may be connected to the adjustable component 226 to assist in completely preventing the flow of water through the nozzle 200.

Figure 4:
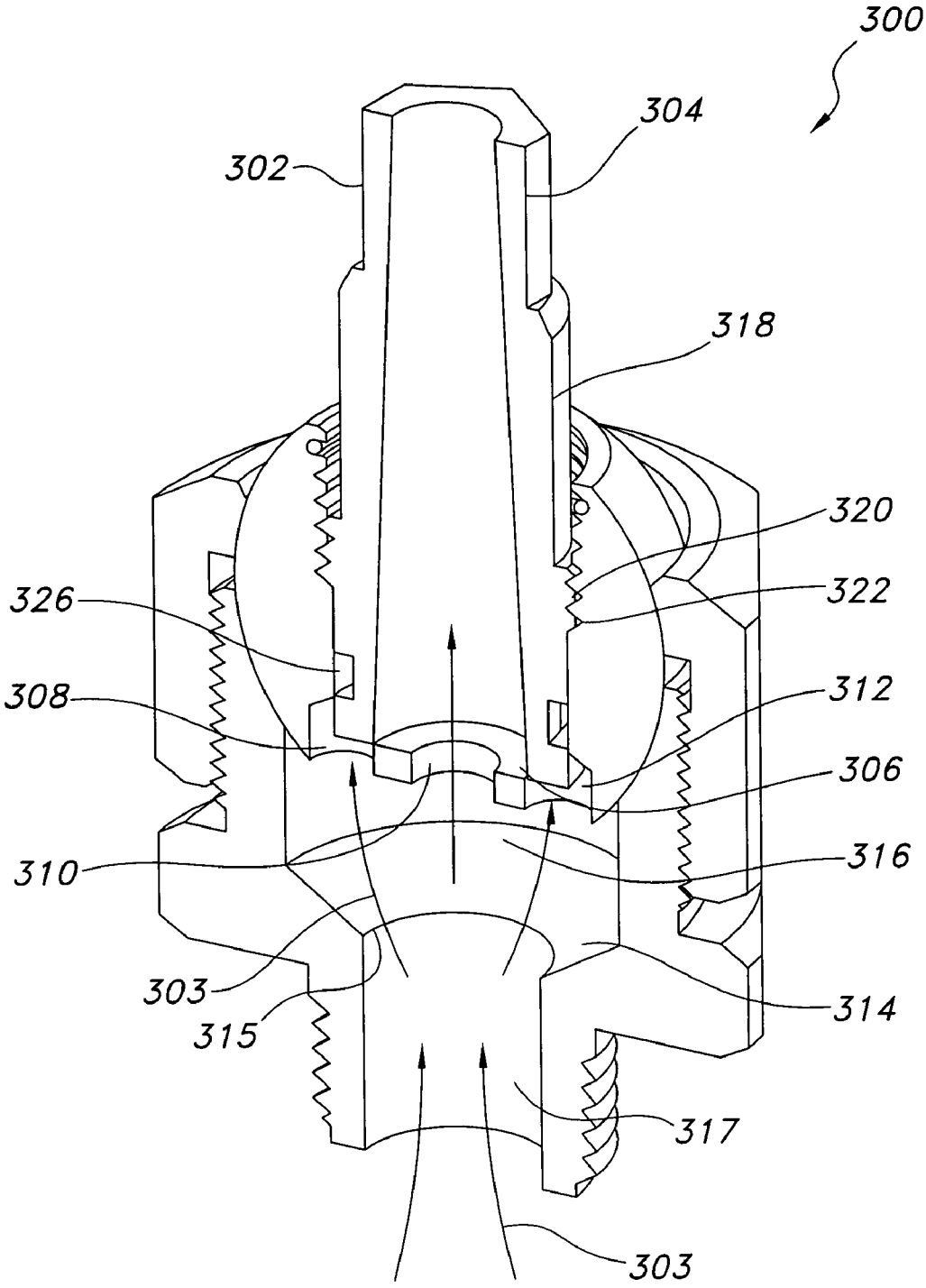
FIG. 4 is a cut-away view of a nozzle having an adjustable spout according to one embodiment of the present invention.

FIG. 4 shows a nozzle 300 having an adjustable spout 302 to control the volume and velocity of the flow of water, as shown by arrows 303, through the nozzle 300. The adjustable spout 302 includes a first end 304 having an opening to allow water to exit the nozzle and a second end 306 having a one or more openings 308, 310, 312 for allowing water to enter the adjustable spout 302 from a nozzle chamber 316. The nozzle chamber 316 has a nozzle chamber ledge 314 defining a nozzle chamber second end 315 connected to a nozzle second end 317. The nozzle second end 317 has an opening for allowing water to enter the nozzle 300 and nozzle chamber 316.

The adjustable spout 302 may have an outer surface 318 with at least a portion that is threaded 320 for connecting the adjustable spout 302 to an inner wall of the nozzle or a ball socket 322. In some embodiments, the ball socket 322 may allow the angle of the adjustable spout 302 to be changed and include a surface 324 for receiving the adjustable spout threaded portion 320. The adjustable spout first end 304 is configured to receive a tool, such as a wrench or other similar device, to rotate the adjustable spout 302 from the outside. Although the adjustable spout first end 304 in FIG. 4 has a hexagonal shape, it may be any shape configured to receive a tool or otherwise allow rotation of the adjustable spout 302.

The adjustable spout openings 308, 310, 312 cooperate with the nozzle chamber ledge 314 to impinge the flow of water. Depending on the location of the adjustable spout 302 relative to the nozzle chamber ledge 314, the flow of water through the nozzle may be impinged more or less. To change the position of the adjustable spout 302, a tool is connected to the adjustable spout first end 304 and is used to rotate the adjustable spout 302. When the adjustable spout 302 is rotated in one direction, the adjustable spout 302 is adjusted downward and towards the nozzle chamber ledge 314, thereby increasing the impingement experienced by the water flowing through the nozzle 300, decreasing the water flow volume, and increasing the water flow velocity. When the adjustable spout 302 is rotated in the opposite direction, the adjustable spout 302 is adjusted away from the nozzle chamber ledge 314, thereby decreasing the impingement experienced by the water flowing through the nozzle 300, decreasing the water flow volume, and increasing the water flow velocity.

The adjustable spout 302 illustrated in FIG. 4 may further include a groove 326 for receiving a seal, such as an O-ring, to prevent water or other liquid from reaching other nozzle components, such as portions of the ball socket 322.

Figure 5:
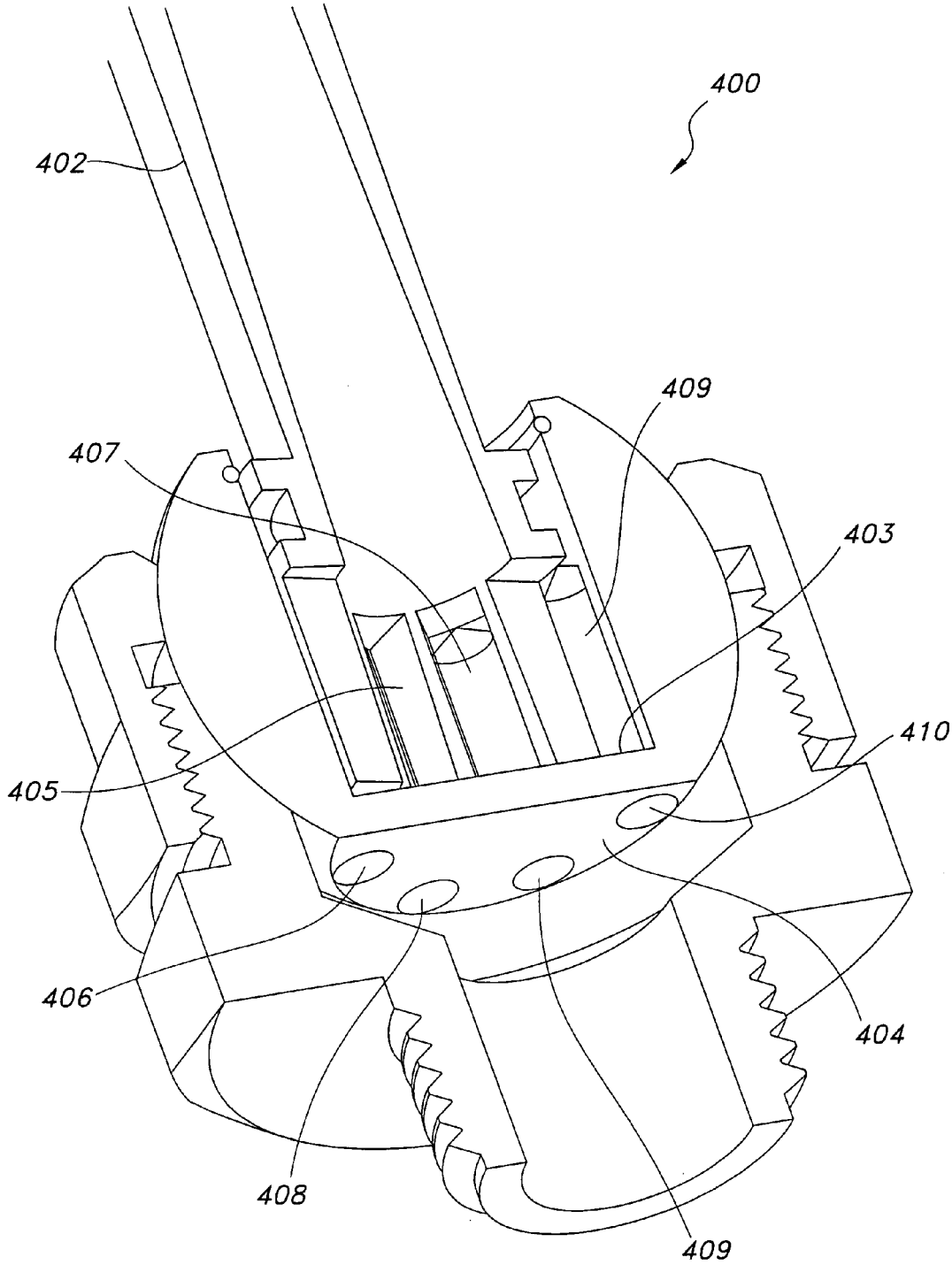
FIG. 5 is a cut-away view of a nozzle having a rotatable adjustable spout according to one embodiment of the present invention.

FIG. 5 shows a nozzle 400 having an adjustable spout 402 that may be rotated using a tool but, unlike the embodiment illustrated in FIG. 4, is not translated upward and downward. Instead, the adjustable spout 402 has a second end 403 having a plurality of openings or channels 405, 407, 409 that cooperate with a nozzle chamber first end 404. The nozzle chamber first end 404 has a plurality of openings 406, 408, 410 to impinge the flow of water through the nozzle 400. For example, the adjustable spout 402 may be rotated in a first position allowing water to flow through openings 406 and 410. Alternatively, adjustable spout 402 may be rotated to a second position allowing water to flow only through opening 406. Other alternatives include, for example, rotating the adjustable spout 402 such that water flows through only a portion of one or more of openings 406, 408, 410 or through none of the openings. In addition, those skilled in the art will recognize that openings 406, 408, 410 may be any shape or size. Accordingly, the volume and velocity of water flowing through the nozzle may be controlled by rotating the adjustable spout 402.

Figure 6:
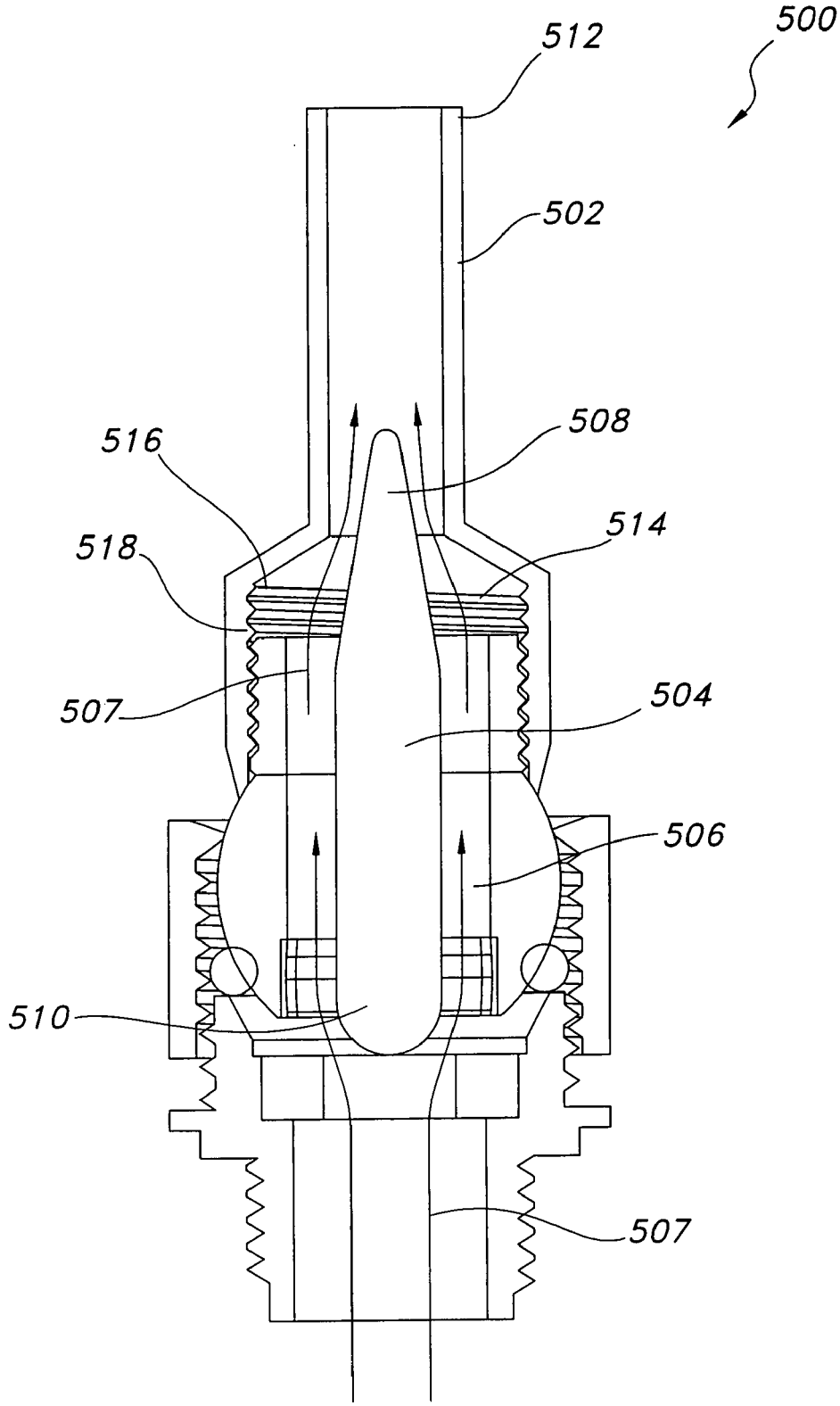
FIG. 6 is a cross-sectional view of a nozzle having an adjustable spout according to one embodiment of the present invention.

FIG. 6 shows a nozzle 500 having an adjustable spout 502 that cooperates with an impinging component 504 preferably located in a nozzle chamber 506 to impinge the flow of water, as shown by arrows 507. The impinging component 504 may have a first end 508 that is tapered to impinge the flow of water at different levels, depending on the location of the adjustable spout 502, and a second end 510 that is rounded for directing the flow of water through the nozzle chamber 506. The impinging component 504, however, may be any size or shape configured to cooperate with the adjustable spout 502 to impinge the flow of water through nozzle 500.

The adjustable spout 502 may have a first end 512 having an opening for allowing water to exit the nozzle and configured to receive a tool, a second end 514 for cooperating with the impinging component 504 to impinge the flow of water through the nozzle 500, and a outer surface 516. A portion of the outer surface 516 may be threaded to connect the adjustable spout 502 to an inside wall 518 of the nozzle 500. To control the volume and velocity of the water flow, a tool, such as a wrench or other similar device, is connected to the adjustable spout first end 512 and used to rotate the adjustable spout 502. When the adjustable spout 502 is rotated in one direction, the adjustable spout 502 may be moved downward and toward the impinging component 504, thereby increasing the impingement experienced by the flow of water through the nozzle 500, decreasing the volume of water exiting the nozzle 500 and increasing the velocity of the water flow. When the adjustable spout 502 is rotated in the opposite direction, the adjustable spout 502 may be moved upward and away from the impinging component 504, thereby decreasing the impingement experienced by the flow of water through the nozzle 500, increasing the volume of water exiting the nozzle 500 and decreasing the velocity of the water flow. Accordingly, the volume, velocity, and thus the distance of the stream of water exiting the nozzle may be adjusted without disassembling the nozzle.

Figure 7:
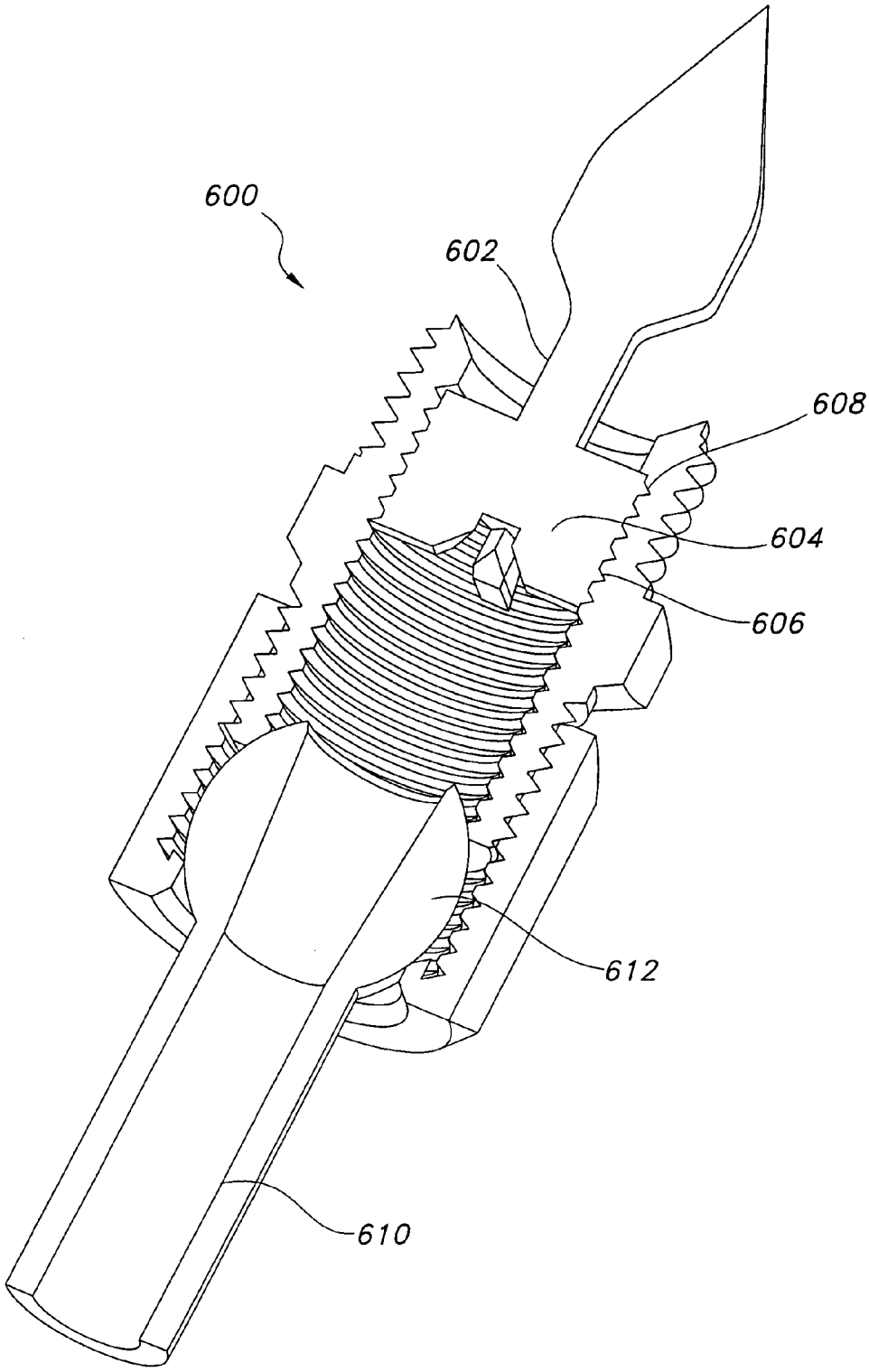
FIG. 7 is a cross-sectional view of a nozzle having an adjustable component and spout according to one embodiment of the present invention.

FIG. 7 shows a cross-sectional view of a nozzle 600 having a valve 602 with an adjustable component 604. The adjustable component 604 includes a threaded outer surface 606 mechanically communicating with a threaded nozzle inner surface 608. The adjustable component 604 may be adjusted manually, or by using a tool to, rotate or otherwise change the position of the adjustable component 604 within the nozzle 600. In some embodiments, the valve 602 extends outside of the nozzle cavity, allowing a portion of the valve 602 to be accessible. The portion may be rotated manually or using a tool to adjust the position of the valve 602 within the nozzle cavity. For example, the nozzle 600 may be removed from a fountain and the valve portion extending outside the nozzle cavity may be accessed manually or using a tool to rotate the valve 602 to change the position of the valve 602 within the nozzle cavity.

The nozzle 600 also includes a spout 610 having a ball socket 612. The ball socket 612 may be adapted to change position to allow water to exit the nozzle 600 at a desired angle.

Figure 8:
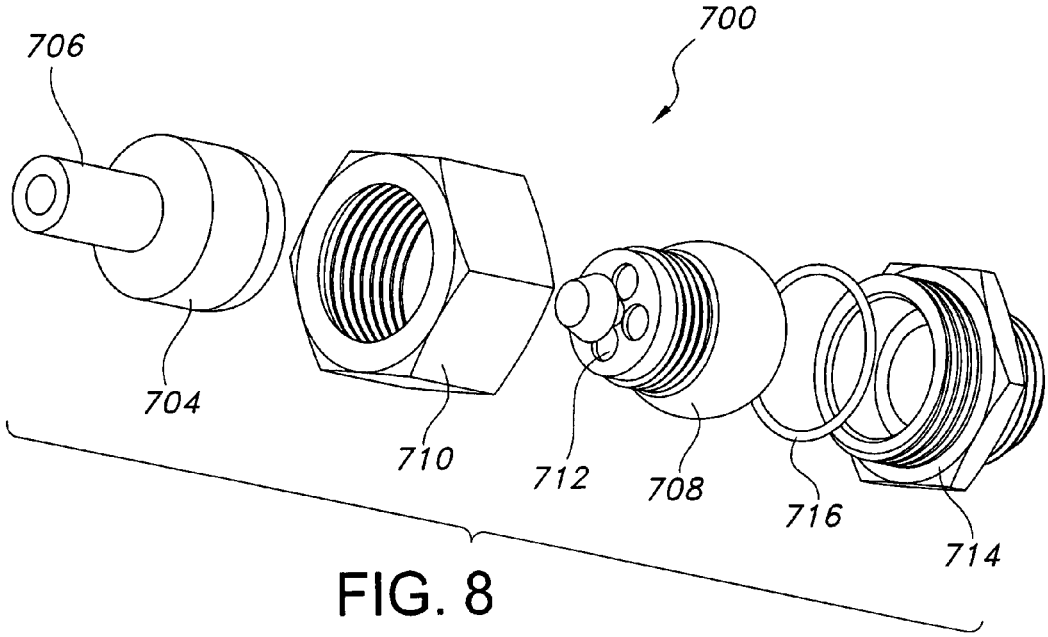
FIG. 8 is an exploded view of a nozzle having an adjustable component according to one embodiment of the present invention.
Figure 9:
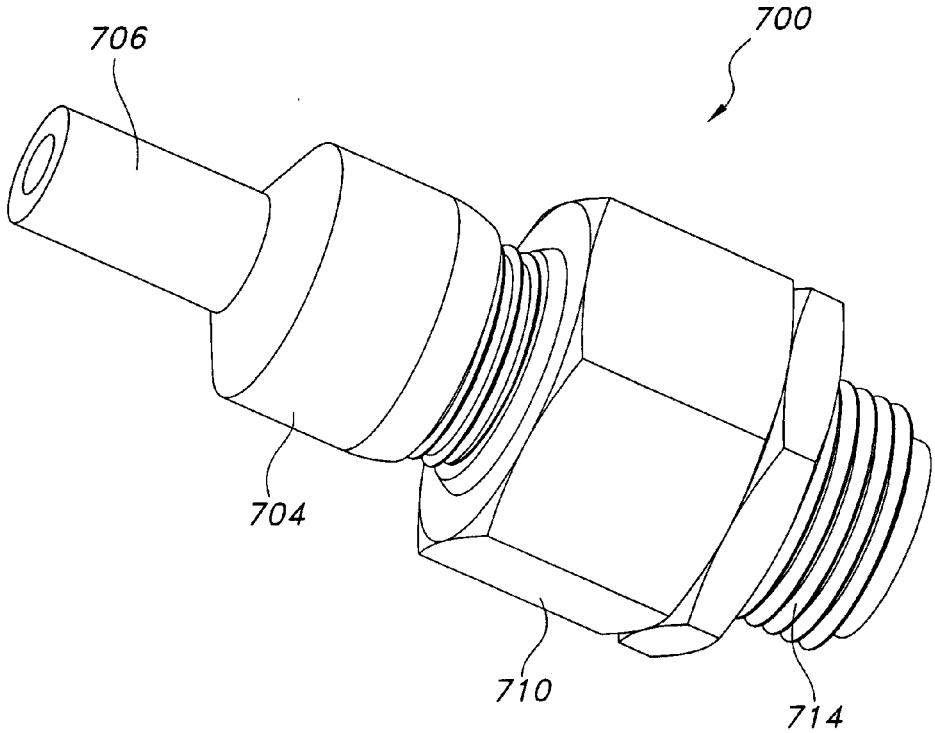
FIG. 9 depicts the assembled nozzle of FIG. 8.

FIG. 8 shows an exploded view of a nozzle 700 according to one embodiment of the present invention. The nozzle 700 includes a first end 704 including a spout 706 that can be connected to a valve 708 with nut 710. The valve 702 includes an adjustable component having a plurality of openings 712 that cooperate with the first end 704 to impinge the flow of water through the nozzle 700. The valve 702 can be connected to a nozzle second end 714 with nut 710 and an O-ring 716. FIG. 9 shows the nozzle 700 assembled. A tool (not shown) may be inserted through an opening in the second end 714 and used to adjust the position of the adjustable component.

The foregoing is provided for purposes of illustrating, explaining, and describing embodiments of the present invention. Further modifications, adaptations and additional components added to these embodiments will be apparent to those skilled in the art and may be made without departing from the scope or spirit of the invention.

What is claimed is:

1. An adjustable nozzle comprising:

a first end having a first opening for allowing water to exit;

a second end having a second opening for receiving water;

an adjustable component for controlling water flow through the nozzle, wherein the adjustable component is adapted to be adjusted by a tool received through the first opening to adjust characteristics of water flow exiting the first opening, wherein the adjustable component is capable of detachably coupling to the tool without disassembling the nozzle, of changing position based on rotation of the tool, and of decoupling from the tool; and a ball socket coupled to a nozzle spout, the nozzle spout being at the first end, wherein a position of the ball socket is adapted to be adjusted to change an angle of water flow exiting the nozzle spout.

2. The adjustable nozzle of claim 1, wherein the adjustable component is longitudinally adjustable to adjust characteristics of water flow exiting the first opening.

3. The adjustable nozzle of claim 1, wherein the adjustable component is rotatably adjustable to adjust characteristics of water flow exiting the first opening.

4. The adjustable nozzle of claim 1, wherein the tool is a screwdriver.

5. The adjustable nozzle of claim 1, wherein the adjustable component comprises:

a first end for connecting to the tool to adjust the adjustable component;

a second end for cooperating with a nozzle wall to impinge water flow;

an outer surface, wherein at least a portion of the outer surface is threaded for coupling with the nozzle wall; and wherein the amount of water flow impinged is based on a position of the adjustable component.

6. The adjustable nozzle of claim 1, wherein the adjustable component comprises:

a first end comprising a plurality of openings and configured to adjustably impinge water flow;

a second end configured to connect to the tool for adjusting a position of the adjustable component; and wherein the adjustable component is adjustable rotatably and longitudinally.

7. The adjustable nozzle of claim 6, wherein the amount of water flow impinged is based in part on a position of the plurality of openings.

8. The adjustable nozzle of claim 1, wherein the characteristics of water flow comprise volume and velocity of water flow.

9. The adjustable nozzle of claim 1, wherein the nozzle spout is adapted to be adjusted manually or using the tool.

10. A method for adjusting water flow characteristics through a nozzle comprising an adjustable component, the method comprising:

inserting a tool into an opening of the nozzle, the opening being configured to allow water to exit the nozzle;

detachably coupling the tool to the adjustable component without disassembling the nozzle;

rotating the tool to change a position of the adjustable component; and removing the tool from the opening; and adjusting a ball socket connected to a nozzle spout that is at the opening to change an angle of water exiting the nozzle spout by detachably coupling a spout tool to the ball socket and moving the spout tool to change a position of the ball socket.

11. The method of claim 10, further comprising:

preventing water flow through the nozzle before inserting the tool into the opening; and allowing water flow through the nozzle after removing the tool from the opening.

12. The method of claim 10, wherein rotating the tool to change the position of the adjustable component comprises:

changing the position of the adjustable component longitudinally relative to a second opening of the nozzle, the second opening of the nozzle being configured to receive water.

13. The method of claim 10, wherein water flow characteristics comprise water flow volume and velocity.

* * * * *